United States Patent [19]

Marr

[11] Patent Number: 4,506,983

[45] Date of Patent: Mar. 26, 1985

[54] BULK MATERIAL STORAGE AND MIXING APPARATUS

[76] Inventor: Leonard D. Marr, 1147 Yorkshire, Carrollton, Tex. 75006

[21] Appl. No.: 344,384

[22] Filed: Feb. 1, 1982

[51] Int. Cl.[3] ..... B28C 5/20

[52] U.S. Cl. ..... 366/44; 366/59; 366/192; 366/227; 366/233; 366/63

[58] Field of Search ..... 366/44, 54, 56, 57, 366/59, 60, 186, 220, 225, 227, 228, 229, 233; 188/77 W, 77 R

[56] References Cited

U.S. PATENT DOCUMENTS

| | | | |
|---|---|---|---|
| 903,298 | 11/1908 | Lillard | 366/227 |
| 1,781,965 | 11/1930 | Ball | 366/59 |
| 1,928,380 | 9/1933 | Jaeger et al. | 366/44 |
| 2,589,492 | 3/1952 | Graham | 366/59 |
| 2,781,186 | 2/1957 | Marbers et al. | 188/17 R |
| 3,567,190 | 3/1971 | Moran | 366/59 |
| 4,154,534 | 5/1979 | Lawrence et al. | 366/59 |

*Primary Examiner*—Philip R. Coe
*Assistant Examiner*—Frankie L. Stinson
*Attorney, Agent, or Firm*—Hubbard, Thurman, Turner & Tucker

[57] ABSTRACT

A portable dry bulk material storage and mixing unit comprising a generally cylindrical drum mounted on a frame for rotation about a generally horizontal axis and having a conical discharge nozzle with a cylindrical discharge opening at one end thereof. The drum interior is fitted with three flights of helical material mixing and discharge fins having a helix angle of approximately 45°. The drum discharge nozzle extends into a hopper disposed at the rear of a truck on which the frame is mounted. An adjustable valve closure member is operable to be disposed over the discharge opening and includes a handwheel for adjustably positioning the closure member to vary the discharge flow area.

13 Claims, 5 Drawing Figures

BULK MATERIAL STORAGE AND MIXING APPARATUS

BACKGROUND OF THE INVENTION

1. Field of the Invention

The present invention pertains to a portable storage and mixing apparatus for bulk material such as cement mixtures including a generally horizontally disposed rear discharge drum having an improved configuration of mixing and discharge fins and a closure valve for the drum discharge opening.

2. Background Art

In the art of bulk material mixing units, particularly wet concrete mixers, it is conventional to provide a rotary mixing drum having two flights of internal helical fins to assist in the mixing operation and to provide for discharging the mixed material from the drum. Conventional portable or transit type wet concrete mixers are also characterized by a rotary drum having an inclined axis of rotation and a somewhat upwardly inclined discharge opening. Conventional transit concrete mixers are further characterized by the lack of a closure member over the discharge opening since the mixer drum is disposed at an upwardly inclined angle and the drum is normally rotated in a direction during mixing which causes the helical mixing fins to urge the material away from the discharge opening.

However, there are a number of applications for various types of cement materials wherein it is desirable to transport a dry mixture of cement and aggregate for mixing with water or other liquids at the site of application of the concrete itself. For example, in the cementing of oil wells, it is desirable to be able to transport casing cements and the like to the well site in quantities which may be easily transported by conventional highway truck and which may be stored on board the truck at the well site until required for use. Such applications for cement, as well as certain other bulk materials, require a storage and mixing unit which is capable of relatively rapid discharge of a uniform flow stream of dry bulk material at the work site wherein the liquid is added to the dry mixture just prior to cementing the well or other use of the material in its final application.

Conventional transit mixers for wet concrete mixtures are not well suited for the mixing and discharge of quantities of dry bulk materials. For example, as previously indicated, wet concrete mixers are typically designed with only two flights of mixing fins which are sufficient to assure that relatively continuous mixing of the material occurs during transit and prior to application, said mixing being primarily to prevent hardening of the mixture before it is discharged at the work site. The design of the mixing fins does not particularly seek, as a major objective, uniform flow of material out of the mixer drum during the discharge operation since the mixture is complete, that is, the liquid is already added in the mixing drum itself and a uniform flow rate is not as critical as with mixers wherein the liquid is added to the flow stream being discharged from the mixer drum.

Another problem associated with bulk material storage and mixing apparatus pertains to the control of the flow of material being discharged from the storage and mixing drum at the work site. The preferred arrangement of a generally horizontal cylindrical mixing drum provided with improved mixing and discharge fins has dictated the requirement for an improved discharge flow control device which also serves as a closure member for the drum discharge opening.

Accordingly, the present invention is directed to improvements in bulk material storage and mixing units which fill a particular need in regard to equipment adapted to handle dry bulk materials such as cement and cement aggregate substances wherein the requirements and desiderata for such types of storage and mixing units have not been met by prior art apparatus.

SUMMARY OF THE INVENTION

The present invention provides an improved bulk material storage and mixing unit which is particularly adapted for use as a portable truck mounted mixer for transporting and mixing dry cement materials. In accordance with one aspect of the present invention, an improved bulk material storage and mixing unit is characterized by a generally cylindrical drum adapted to be mounted on a transport vehicle such as a motor truck for rotation about a generally horizontal axis and further being provided with a rearwardly disposed coaxial discharge opening through which the materials stored in the drum may be uniformly discharged at a controllable rate.

In accordance with another aspect of the present invention, there is provided a portable storage and mixing drum particularly adapted for mixing and uniformly discharging dry bulk materials such as cement, aggregate material and other admixtures. The mixing drum of the present invention is particularly adapted for short or long term storage of quantities of dry bulk material, mixing of the material prior to discharge from the drum, and uniform discharge of the material at a controllable flow rate. In particular, it has been determined that an improved geometry of flights of internal mixing and discharge fins, in combination with a cylindrical drum having a conical discharge nozzle end, provides for superior mixing of the materials within the drum and for a uniform discharge flow rate. In accordance with one embodiment of the present invention, a series of three uniformly spaced flights of mixing and discharge fins are provided having a helix angle of approximately 45° throughout the major portion of the drum but changing to a substantially axial or 0° helix angle at the drum discharge opening. A particular configuration of the mixing and discharge fins is also provided to assure complete discharge of the drum material through an opening formed in the apex of a frusto conical drum discharge portion.

Still further in accordance with the present invention, there is provided a mixing drum for bulk materials having a closure member for the material discharge opening which is of improved construction which enables tight sealing of the discharge opening for transit and storage purposes but which is easily opened a variable controlled amount for relatively fine control of the discharge of material from the drum.

In accordance with yet another aspect of the present invention there is provided an improved material discharge hopper structure arranged at the opening of the storage and mixing drum which provides for easy access to the drum discharge opening and the closure member for controlling the flow of material from the discharge opening.

The present invention provides additional advantages and superior features for a transit type storage and mixing drum particularly suited for dry bulk materials, which advantages and features will be appreciated by those skilled in the art upon reading the detailed description which follows in conjunction with the drawings.

DESCRIPTION OF THE PREFERRED EMBODIMENT

Figure 1:
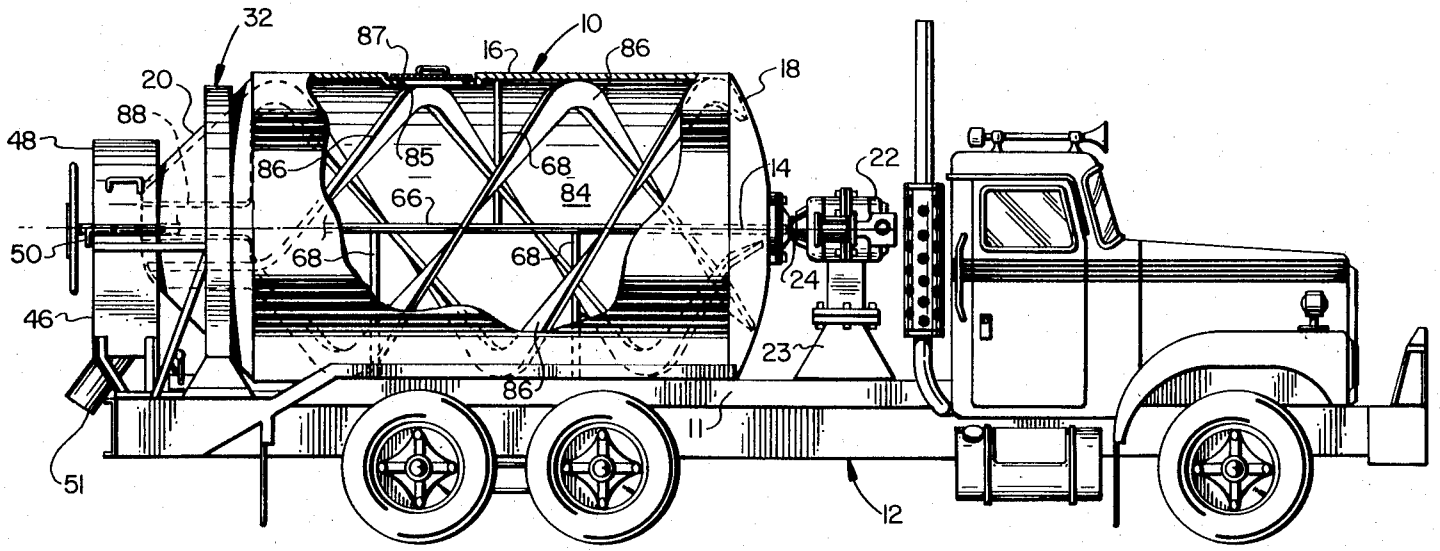
FIG. 1 is a longitudinal side elevation of a truck mounted storage and mixing apparatus in accordance with the present invention.

In the description which follows, like parts are indicated with the same reference numerals throughout the description and drawings, respectively. The drawings are not necessarily to scale and in certain views the scale of the parts may be exaggerated to better illustrate the inventive features.

Figure 2:
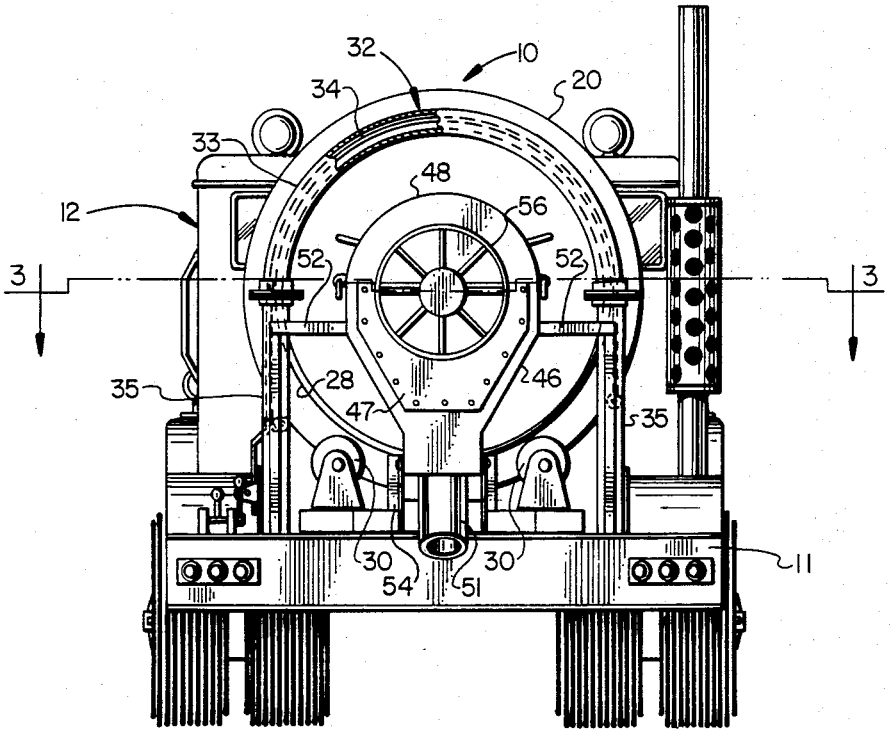
FIG. 2 is an end view of the apparatus shown in FIG. 1.

Referring to FIGS. 1 and 2, the present invention is particularly adapted to be used as a portable storage and mixing apparatus for transporting flowable dry bulk materials to be used in various concrete and cementing applications. The apparatus illustrated in FIG. 1 comprises an elongated cylindrical drum 10 mounted on a frame 11 which is adapted to be mounted on a tandem axle motor truck 12. The drum 10 is particularly adapted to be rotated about a horizontal axis designated by the numeral 14. The drum 10 includes an elongated cylindrical part 16, a transverse head portion 18 and a generally frusto conical shaped material discharge nozzle 20. A portion of the cylindrical part 16 is broken away in FIG. 1 to illustrate details of the interior structure. The drum 10 is supported on the frame 11 at the drum forward end by a power transmission unit, generally designated by the numeral 22. The transmission unit 22 includes an output shaft portion 24 which is provided with a suitable drive flange adapted to be bolted to the head 18 in supportive relationship to the forward end of the drum and for rotatably driving the drum at a predetermined speed. The transmission unit 22 is supported on a pedestal portion 23, which in turn is supported on the frame 11. The transmission unit 22 may be one of several types commercially available and which are adapted to be driven by a hydraulic motor interconnected with a hydraulic pump driven by the truck engine, not shown. The transmission output shaft 24 is controllable for rotation in opposite directions at variable speed by suitable control valves arranged to control the flow of hydraulic fluid to the aforementioned drive motor, not shown. Other types of transmission units including chain drive type units may also be adapted for rotating the drum 10.

The drum 10 also includes a cylindrical support ring 28 forming a circumferential bearing surface disposed on the conical discharge nozzle portion 20. The support ring 28 is engageable with spaced apart support rollers 30 disposed on the frame 11, as shown in FIG. 2. The support ring 28 is shielded by a somewhat arched frame member 32 disposed on the main frame 11. The top portion 33 of the frame member 32 is removably bolted to opposed upstanding leg portions 35.

Figure 5:
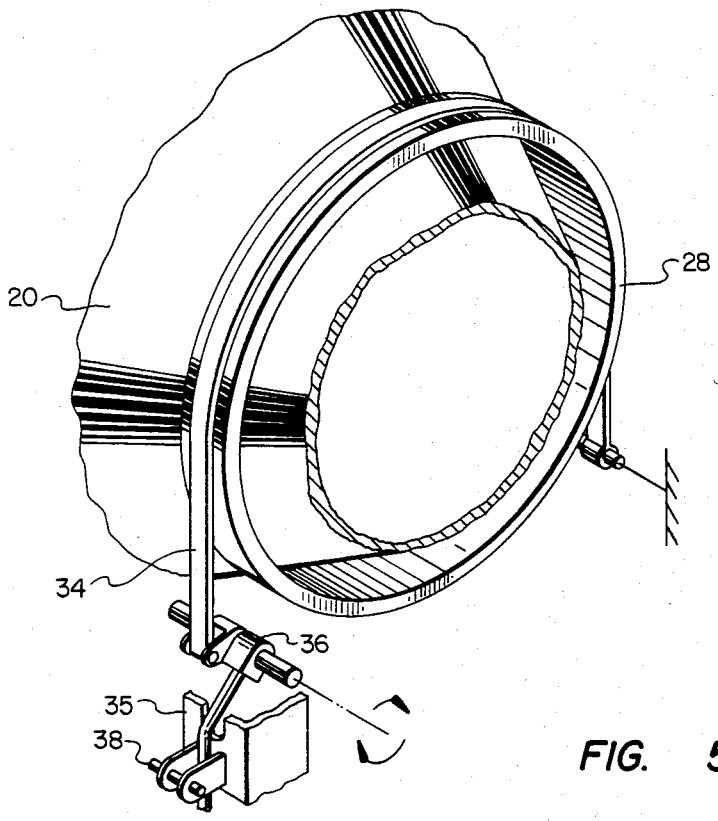
FIG. 5 is a detail perspective view of the drum hold down mechanism.

Referring to FIGS. 2 and 5, the drum 10 also includes a brake or drum hold down mechanism adapted to prevent unwanted rotation of the drum and to bias the support ring 28 into secure engagement with the rollers 30 during transport operations or when it is otherwise desired to prevent rotation of the drum. The hold down mechanism includes an elongated flat steel band member 34 which is suitably secured at one end to one leg 35 of the frame member 32 and passes around the upper portion of the support ring 28 in a generally inverted U-shaped arrangement. Referring particularly to FIG. 5, the opposite end of the band 34 is connected to a lever 36 which is pivotally mounted on the other leg portion 35. The lever 36 is adapted to be secured in a position, such as the position shown in FIG. 5, for forcibly engaging the band 34 with the support ring 28 to prevent rotation of the drum 10 and to primarily secure the drum in forcible engagement with the rollers 30 to prevent damage to the rollers and the support ring during transport. In the position shown in FIG. 5, the lever 36 is locked by a retaining pin 38 in the position which binds the band 34 in forcible engagement with the support ring 28. Upon pivotal movement of the lever in the direction indicated by the arrows in FIG. 5, the band 34 is released to allow rotation of the drum 10 by the transmission unit 22.

Figure 3:
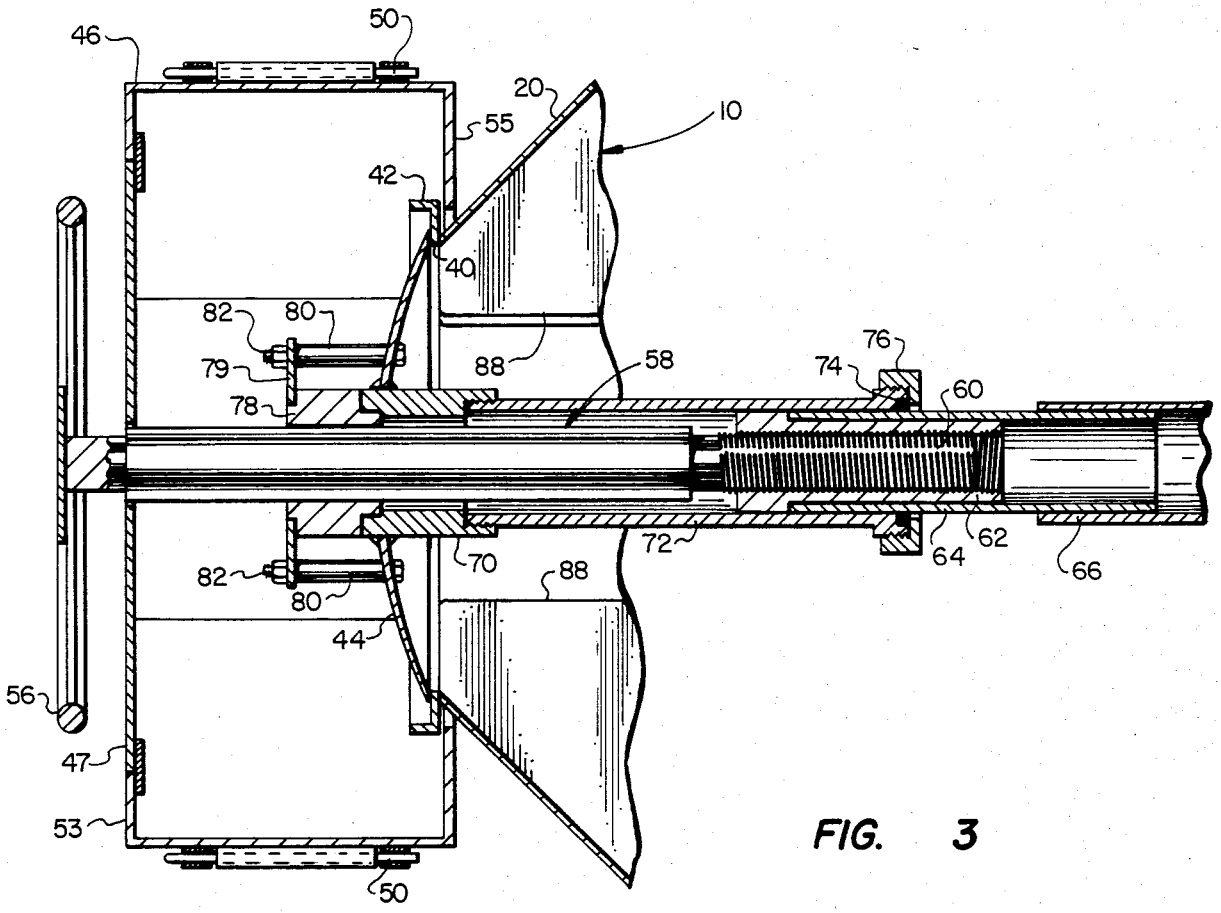
FIG. 3 is a detail section view taken along the line 3—3 of FIG. 2.

Referring further to FIGS. 1, 2, and 3, the storage and mixing drum 10 includes an axial discharge opening designated by the numeral 40 in FIG. 3 and formed by a cylindrical flange 42 delimiting the conical shaped discharge nozzle 20. A cylindrical and somewhat dish shaped closure member 44 is adapted to be disposed over the discharge opening 40 and in sealing engagement with the flange 42. The closure member 44 is adapted to be controllably opened for selective control of the discharge of material from the interior of the drum 10 by improved mechanism to be described in further detail hereinbelow.

Material discharged from the opening 40 is conducted through a discharge hopper 46 having a cover member or hood 48 which is secured to opposite top sides of the hopper by removable hinge pins 50. The discharge hopper 46 includes a generally downwardly disposed discharge duct portion 51 for discharging material being unloaded from the drum 10. The discharge hopper 46 is suitably mounted on the frame 11 by support members 52 and 54. Thanks to the provision of the hinged cover member 48, inspection of the interior of the hopper 46 may be obtained by removing one or the other of the pins 50 and swinging the cover member open. A front cover member 47 is also removably bolted to the front sidewall 53 of the hopper 46 to provide further access to the interior of the hopper and to the closure member 44. The apex of the discharge nozzle 20 extends through an opening formed in a rear sidewall 55 of the hopper 46, and the flange 42 is proportioned to overlap the sidewall to minimize spillage of material through the opening.

Referring further to FIG. 3, the closure member 44 is operable to be moved between a maximum open position and a closed position, with respect to the discharge opening 40, by a handwheel 56 connected to an elongated shaft or stem member 58 having a threaded portion 60. The threaded portion 60 is engaged with cooperating internal threads formed on an elongated bronze sleeve 62 which is fixed to an elongated tubular support member 64, as shown. The support member 64 extends in sleeved relationship within an elongated central support tube 66. The tube 66 extends coaxially through the interior of the drum 10 and is supported therein by plural, spaced apart, radially extending support arms 68, as shown in FIG. 1.

The closure member 44 includes a cylindrical hub portion 70 including an elongated sleeve 72 which is disposed in telescoping sleeved relationship over the tubular members 62 and 64. The distal end of the sleeve member 72 is provided with a groove for receiving a resilient packing 74 which is retained in the groove by a packing nut 76 whereby a slidable, substantially fluid tight seal is formed between the sleeve 72 and the tubular members 62 and 64 to prevent material within the interior of the drum 10 from fouling the threaded portion 60, cooperating threads on the shaft portion 60 and the member 62.

The hub 70 is engaged with and rotatable relative to a cylindrical collar 78 fixed to the shaft 58 whereby, in response to rotation of the handwheel 56 to move the shaft toward the support tube 66, the closure member 44 is moved into forcible engagement with the flange 42 to form a fluid tight seal over the discharge opening 40. However, in response to rotation of the handwheel 56 in the opposite direction, the collar 78 engages a plate 79 supported on the closure member 44 by two opposed spacer elements 80 and elongated bolts 82. Accordingly, as the handwheel 56 is rotated to move the shaft 58 axially out of the tubular sleeve 62, the collar 78 engages the plate 79 to move the closure member 44 away from the opening 40. When the drum 10 is rotating, the closure member 44, as well as the handwheel 56 and the associated opening and closing mechanism rotate with the drum. However, the provision of the actuating mechanism for the closure member comprising the stem 58 together with the collar 78 and the operating handwheel 56 provides for axial movement of the closure member 44 with respect to the drum 10 to vary the size of the effective flow area between the discharge opening 40 and the hopper 46. The arrangement illustrated in FIG. 3 permits not only the fine adjustment of the size of the discharge opening so as to control the flow of material being discharged from the drum 10, but also provides for tight closure of the closure member 44 against the flange 42 without the necessity of rotating the closure member and encountering the accompanying forces that would be required to suitably engage the perimeter of the closure member with the flange 42.

The storage and mixing apparatus of the present invention is also characterized by improved means formed within the interior of the drum 10 to provide for suitable mixing of material placed within the drum and to also provide a substantially uniform discharge flow rate for material being discharged from the drum when it is desired to do so. Referring again to FIG. 1, the drum 10 includes a material loading port 85 formed in the wall of the cylindrical drum part 16 and which is closed by a removable cover member 87. The interior of the drum 10, generally designated by the numeral 84, is provided with a plurality of helical fins 86 which are disposed on the inner wall of the cylindrical part 16 and also extend into the conical discharge nozzle portion 20. In pursuing the present invention, it has been determined that an optimum of three fins provides for uniform discharge of the material within the drum, such fins being spaced equidistant from each other circumferentially around the interior of the drum and forming a helix or lead angle of approximately 45° with respect to the central longitudinal axis 14.

Although conventional wet type concrete mixer drums are normally provided with two equally spaced flights of mixing and discharge fins, this arrangement does not provide for the more uniform discharge flow requirements of dry bulk materials such as cement. In particular, in regard to cementing of oil wells and the like, the procedure involves the mixing of the bulk material with water in a mixing unit separate from the mixing drum 10. Accordingly, the proper feeding of dry material into the aforementioned mixing unit requires a substantially uniform flow of material. Although the teaching of the art in wet type concrete mixing drums indicates that two fins are adequate, the requirements for discharge flow rates of material from wet concrete mixer drums are not as critical as the requirements for the discharge of dry mixes in combination with mixing equipment requiring a fairly uniform flow rate. Accordingly, the teaching of the prior art in mixing apparatus for wet concrete has proved to be in error with regard to the provision of suitable discharge flow rates in dry type bulk material storage and mixing apparatus. On the other hand, the doubling of the number of mixing and discharge fins from the number used in wet concrete mixers has not proved to be satisfactory because the flow area of the discharge passages formed by the fins is insufficient for the relatively small discharge opening which optimum design of a mixing drum dictates. Accordingly, for drums adapted to be mounted on highway type motor trucks and the like, the maximum overall diameter limit dimension of the drum does not permit four or more fins to be used because of the insufficient flow area provided at the discharge nozzle. In accordance with the discovery of the present invention, an arrangement of three uniformly spaced helical fins having geometry as described herein has proven to provide a uniform discharge flow of material through the discharge nozzle.

It has been further determined in accordance with the present invention, that the arrangement of a generally horizontally disposed mixing drum provides for improved mixing as well as substantially complete discharge of the materials disposed within the drum interior. Since the cylindrical drum must be rotated to provide the discharge flow, it has been deemed advantageous to provide a conical type discharge nozzle having a central cylindrical discharge opening. With this arrangement, it has also been determined that the lead angle of the mixing and discharge fins should be reduced from the maximum amount in a cylindrical portion of the drum to approxmately 0° at the discharge opening 40 thereby providing a substantially axial portion 88 of the fins 86, as illustrated in FIGS. 1, 3 and 4.

Figure 4:
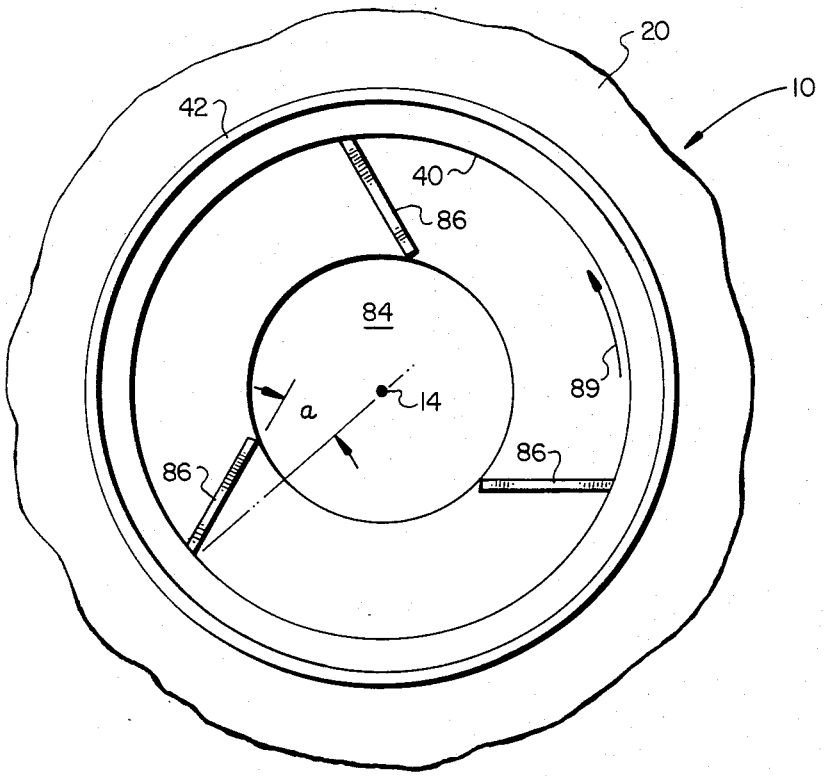
FIG. 4 is a detail end view of the mixer drum showing the mixing and discharge fin configuration.

As shown also in FIGS. 1, 3 and 4, the width of the fins at the discharge end thereof is desirably increased sufficiently such that through a major portion of the axial length of the discharge nozzle 20 the fins are of a width wherein the inner longitudinal edges of the fins are at a substantially constant radial distance from the axis 14. Accordingly, the fins 86 sweep an area which is delimited by a circle having a radius equal to the distance of the longitudinal edges of the fins from the axis 14 at the discharge opening 40. Therefore, material being guided by the fins does not spill over the longitudinal edges into the space between adjacent fins without being adequately forcibly guided toward the discharge opening.

The geometry of the fins 86 is also further characterized by a somewhat negative rake angle, a, as indicated in FIG. 4, with respect to the normal direction of rotation of the drum 10 as indicated by the arrow 89 in FIG. 4. The negative rake angle of approximately 15° to 30° with respect to a radial line from the axis 14 and passing through the point of intersection of the fin with the drum surface, has been found to provide a suitable discharge flow rate without causing material to become lodged between the fin and the interior wall surface of the drum. The rake angle of the fins 86 together with the helix or lead angle of approximately 45° has been determined to provide for substantially uniform discharge flow rates of dry bulk materials from the interior 84 of a generally cylindrical horizontally disposed storage and mixing drum of the type described herein. The 45° helix angle of the fins 86 provides a suitable angle which imparts an axial force component on the material to cause movement of the material toward the discharge opening 40 while at the same time providing good mixing characteristics within the drum. Moreover, the curvature of the fins 86 from the 45° lead angle throughout the main portion of the drum to a substantially axial direction at the discharge opening, is indicated to further enhance the uniformity of the flow of material being discharged.

A charge of dry bulk material, such as cement, is normally loaded into the drum 10 through the port 85 and the cover 87 secured thereon. In operation, the drum 10 may or may not be rotated during transit to the work site. If the drum 10 is not rotated during movement of the truck 12, the hold down band 34 is actuated to engage the support ring 28 to prevent rotation of the drum and to clamp the ring forcibly against the rollers 30. The drum 10 may be rotated in either direction to provide for mixing of the material contained therein, but upon commencement of the operation to discharge material through the discharge opening 40, the drum is required to be rotated in the direction indicated by the arrow 89 in FIG. 4, to produce an axial force on the material due to the fins 86 which will urge the material toward the discharge opening 40.

Prior to commencement of rotation of the drum to discharge material, the handwheel 56 is normally actuated to move the closure member 44 away from the opening to a desired position in accordance with the material flow requirements. There is normally sufficient friction between the threads of the shaft 58 and the sleeve 62 such that the shaft will maintain a predetermined axial position with respect to the sleeve during rotation of the drum. The drum 10 is normally rotated at a speed which will permit grasping the handwheel 56 while the drum is rotating to change the position of the closure member 44 during unloading operation to vary the discharge flow rate. A combination of speed of rotation of the drum 10 and a particular setting of the position of the closure member 44 will determine the discharge flow rate of material from the interior chamber 84. Thanks to the provision of the closure member 44, the drum 10 may be maintained in a substantially sealed condition with the closure member forcibly engaged with the flange 42 whereby dry material stored within the drum will not be exposed to contamination and moisture.

The storage and mixing apparatus 10 may be constructed of conventional engineering materials for such types of apparatus. For example, the cylindrical drum part 16, as well as the head portion 18 and the discharge nozzle 20, may be fabricated of steel plate sections suitably welded together. For a drum of six foot nominal diameter and having a capacity of three hundred, 80 lb. sacks of dry cement and other materials the drum may be manufactured of ⅛th inch thick low carbon steel plate. The frame 11, hopper 46 and closure member 44 may also be fabricated of suitable structural steel plate or other standard mill shapes. For a six foot diameter drum, the width of the fins 86 is preferably approximately 15 inches throughout the cylindrical portion of the drum. The fins desirably make at least one complete turn or wrap about the axis of rotation of the drum. The hand of the fins 86 may be of either direction but must, of course, be provided to accommodate the direction of rotation of the drum in the discharge operating mode. However, with a transmission unit of the type referred to herein, the direction of rotation and the speed of rotation of the drum in either direction may be varied as desired.

Although the storage and mixing apparatus 10 described in detail herein is well suited to mixing and dispensing substantially dry bulk materials such as cement and aggregate mixture added thereto, those skilled in the art will appreciate that the teaching of the present invention may be utilized in a storage and mixing unit for wet slurries of cement or other materials such as, for example, oil well drilling mud and the like. Those skilled in the art will also recognize that various substitutions and modifications may be made with respect to certain detailed elements of the embodiment disclosed herein without departing from the scope and spirit of the invention as defined in the appended claims.

What I claim is:

1. A bulk material storage and mixing apparatus for mixing and discharging a quantity of dry bulk material such as cement, said apparatus comprising:

a frame adapted to be mounted on a transport vehicle;

a cylindrical drum mounted on said frame for rotation about a generally horizontal axis of rotation;

drive means mounted on said frame for rotating said drum;

said drum including a closed head at one end and a generally conical shaped discharge nozzle at the opposite end, said discharge nozzle including a material discharge opening formed in a plane substantially perpendicular to said axis of rotation at one end of said discharge nozzle; and three flights of elongated helical mixing and discharge fins formed on the interior of said drum extending from said head to said discharge opening, said fins being substantially equally spaced apart one from the other and extending generally radially inwardly from the inner surface of said drum, said fins being formed at a helix angle with respect to said axis of rotation of approximately 45° over a major portion of the axial length of said fins, said fins having a discharge portion extending substantially axially through said discharge nozzle and having a helix angle of less than 15° with respect to said axis of rotation at said discharge opening, the width of said fins along said discharge nozzle being such that said fins extend radially inwardly at a constant diameter with respect to said axis of rotation along a major portion of the axial length of said discharge nozzle and sweep an annular area delimited at its inner radius by an axially continuous flow area extending entirely through said discharge nozzle, said flow area being defined by a circle having a radius center on said axis of rotation, and said fins have a negative rake angle of approximately 15° to 30° with respect to a radial line passing through said axis of rotation at said discharge opening for discharging said bulk material uniformly through said discharge opening during rotation of said drum.

2. The apparatus set forth in claim 1 wherein:
said drum includes a material loading port formed in a sidewall of said drum and removable cover means for covering said port.

3. The apparatus set forth in claim 1 wherein:
said drum includes a cylindrical bearing surface formed on the periphery thereof, at least two spaced apart rollers mounted on said frame and engaged with said bearing surface in supportive relationship with said drum, an elongated drum hold down band connected at one end to said frame and trained around at least a portion of said bearing surface, the opposite end of said band being engaged with lever means mounted on said frame and operable to tighten said band against said bearing surface to prevent rotation of said drum and to hold said drum in forcible engagement with said rollers.

4. The apparatus set forth in claim 1 wherein:
said apparatus includes a material discharge hopper mounted on said frame and surrounding said discharge opening, said hopper including a hood portion, a depending material receiving portion and means forming a material discharge port at the bottom of said material receiving portion.

5. The apparatus set forth in claim 4 wherein:
said hood portion is hingedly connected to said material receiving portion.

6. The apparatus set forth in claim 1 together with:
a closure member adapted to close said discharge opening, said closure member being connected to means for selectively moving said closure member to uncover said discharge opening for controlling the rate of discharge of material through said discharge opening.

7. The apparatus set forth in claim 6 wherein:
said means for moving said closure member includes a support member connected to said drum, said support member including a threaded portion, an elongated shaft including a portion threadedly engaged with said threaded portion of said support member, a collar fixed to said shaft and engageable with a hub portion of said closure member for moving said closure member axially toward and away from said discharge opening in response to rotation of said shaft.

8. The apparatus set forth in claim 7 wherein:
said hub portion includes an elongated sleeve slidably disposed over said support member and including seal means engageable with said support member.

9. The apparatus set forth in claim 8 wherein:
said means for moving said closure member includes a hand wheel connected to said shaft for rotating said shaft to open and close said discharge opening.

10. A portable bulk material storage and mixing apparatus for mixing and discharging a quantity of dry bulk material such as cement, said apparatus comprising:
a frame adapted to be mounted on a transport vehicle;
a cylindrical drum mounted on said frame for rotation about a generally horizontal axis;
drive means mounted on said frame for rotating said drum;
said drum including a closed head at one end and a generally conical shaped discharge nozzle at the opposite end, said discharge nozzle including a material discharge opening formed in a plane substantially perpendicular to said axis of rotation and defining the apex of said discharge nozzle;
means in the interior of said drum for urging material in said drum toward said discharge opening in response to rotation of said drum;
a material discharge hopper mounted stationary on said frame including a depending material receiving portion and a hood portion supported on and connected to said material receiving portion by hinge means to provide for moving said hood portion between open and closed positions for access to the interior of said material receiving portion, said material receiving portion including a first sidewall at least partially surrounding said discharge opening and being in overlapping relationship to a flange disposed on said drum around said discharge opening, a second sidewall spaced from said first sidewall opposite said discharge opening, and means forming a material discharge port at the bottom of said material receiving portion;
a closure member adapted to close said discharge opening, said closure member being connected to means for selectively moving said closure member to uncover said discharge opening for controlling the rate of discharge of material from said drum, said means for moving said closure member including a support member connected to said drum, said support member including a threaded portion, an elongated shaft extending through said material receiving portion and said second sidewall and including a portion threadedly engaged with said threaded portion of said support member, a collar fixed to said shaft and engageable with a hub portion of said closure member for moving said closure member axially toward and away from said discharge opening in response to rotation of said shaft; and
a handwheel connected to said shaft and disposed outside said material receiving portion adjacent said second sidewall for rotating said shaft to selectively open and close said discharge opening in said drum with said closure member.

11. The apparatus set forth in claim 10 wherein:
said hub portion includes an elongated sleeve slidably disposed over said support member and including means for supporting resilient seal means engageable with said support member to prevent exposure of said threaded portion of said support member to material in said drum.

12. The apparatus set forth in claim 10 wherein:
said hood portion is connected to said material receiving portion by opposed hinge means including removable hinge pins, said hinge pins being selectively removable to permit swinging said hood portion about one of said hinge means between closed and open positions of said hood portion for access to the interior of said hopper.

13. A bulk material storage and mixing apparatus for mixing and discharging a quantity of dry bulk material such as cement, said apparatus comprising:
a frame adapted to be mounted on a transport vehicle;
a cylindrical drum mounted on said frame for rotation about a generally horizontal axis;

drive means mounted on said frame for rotating said drum;

said drum including a closed head at one end and a generally conical shaped discharge nozzle at the opposite end, said discharge nozzle including a material discharge opening formed in a plane substantially perpendicular to said axis of rotation;

plural flights of elongated helical mixing and discharge fins formed on the interior of said drum extending generally from said head to said discharge opening;

means forming a cylindrical bearing surface on the periphery of said drum;

at least two spaced apart rollers mounted on said frame and engaged with said bearing surface in supportive relationship with said drum; and an elongated drum holddown band connected at one end to said frame and trained around only a portion of said bearing surface above said rollers, the opposite end of said band being engaged with lever means mounted on said frame and operable to tighten said band against said bearing surface to prevent rotation of said drum and to hold said drum in forcible engagement with said rollers to prevent damage to said rollers and said bearing surface during transport of said apparatus.

* * * * *